US005736053A

United States Patent [19]

Ikushima et al.

[11] Patent Number: 5,736,053

[45] Date of Patent: Apr. 7, 1998

[54] METHOD OF ELIMINATING MERCURY FROM LIQUID HYDROCARBONS

[75] Inventors: Kenji Ikushima, Yachiyo; Kenji Mimoto, Funabashi; Akinori Nakayama, Okayama; Kiyoto Ohtsuka, Bizen, all of Japan

[73] Assignees: Taiyo Oil Co., Ltd., Tokyo; Kuraray Chemical Co., Ltd., Bizen, both of Japan

[21] Appl. No.: 678,688

[22] Filed: Jul. 11, 1996

[30] Foreign Application Priority Data

Jul. 27, 1995 [JP] Japan ..... 7-211137

[51] Int. Cl.[6] ..... C02F 1/28

[52] U.S. Cl. ..... 210/688; 210/690; 210/914; 585/820; 585/823

[58] Field of Search ..... 210/688, 690, 210/914, 694; 502/216, 416, 417, 427; 585/800, 811, 820, 823, 830, 809; 208/251 R

[56] References Cited

U.S. PATENT DOCUMENTS

| | | | |
|---|---|---|---|
| 3,194,629 | 7/1965 | Dreibelbis et al. | 23/2 |
| 3,873,581 | 3/1975 | Fitzpatrick et al. | 260/320 |
| 3,989,623 | 11/1976 | Neal | 210/688 |
| 4,093,541 | 6/1978 | Piccininni et al. | 210/688 |
| 4,094,777 | 6/1978 | Sugier et al. | 210/688 |
| 4,280,925 | 7/1981 | Kiefer | 210/688 |
| 4,336,237 | 6/1982 | Kudryk et al. | 210/688 |
| 4,474,896 | 10/1984 | Chao | 502/216 |
| 4,874,525 | 10/1989 | Markovs | 210/688 |
| 4,946,596 | 8/1990 | Furuta et al. | 210/679 |
| 5,037,552 | 8/1991 | Furuta et al. | 210/634 |

*Primary Examiner*—Cynthia L. Nessler

*Attorney, Agent, or Firm*—Oblon, Spivak, McClelland, Maier & Neustadt, P.C.

[57] ABSTRACT

Activated carbon is prepared specially by activating carbonaceous material in a circumstance comprising water vapor less than 15% on volume basis and providing thus treated activated carbon carries alkaline or alkaline earth metal sulfide in it. Thus prepared activated carbon or that carrying these compound provides for method of eliminating mercury and its compounds from liquid hydrocarbons substantially completely contained at a slight amount in it. Liquid hydrocarbons containing mercury or sulfur will harm catalysts which are often applied during process for such intermediates of petroleum products and petrochemical products. Thus the present method is advantageous to processing of such oil intermediates.

11 Claims, No Drawings

METHOD OF ELIMINATING MERCURY FROM LIQUID HYDROCARBONS

BACKGROUND OF THE INVENTION

1. Field of the Invention

This invention relates to method of eliminating mercury and its compounds from liquid hydrocarbons, more particularly, to method capable of substantially complete elimination of mercury and its compounds contained at a slight amount in liquid hydrocarbons which are usually intermediates leading to petroleum products and petrochemical products, by means of contacting the liquid hydrocarbons with activated carbon or activated carbon carrying alkaline metal sulfide or the like.

2. Description of the Related Art

Heretofore, alumina based catalyst carrying palladium, for instance, has been used for the hydrogenation process of reforming liquid hydrocarbons, such as naphtha, wherein the hydrogenation reaction suffers from damage with the catalyst if impurity of mercury is present in the liquid hydrocarbons. Then, mercury tends to readily form amalgam with many kinds of metals. For such reason, if an apparatus constructed from aluminum based alloys is involved in such process noted, there is harm of corrosion due to amalgamation with mercury. Accordingly, there has been strong desire for progress in the elimination of mercury from such hydrocarbons.

There has been reported adsorbents for mercury which includes porous adsorbent carrier carried with sulfur. Such adsorbents allegedly effect to eliminate mercury by reaction between mercury and sulfur. Porous adsorbents including conventional activated carbons, zeolite, and alumina with nothing carried, themselves can eliminate mercury by action of physical adsorption, but attainment is as low as 30–70% and adsorption ability drops down extremely when a mercury concentration is less than 10 ppb. These are problems involved in art heretofore.

The art disclosed heretofore concerning adsorbents carrying sulfur is, for example, sulfur carrying activated carbon which is prepared by mixing activated carbon with fine sulfur particles and heating such mixture at 100°–400° C. (Japanese Patent Application Laid Open 59-78915/1984); activated carbon carrying organic sulfur compound (Japanese Patent Application Laid Open 62-114632/1987). As for choice of sulfur compounds, the use of sulfur simple body or organic sulfur compound such as thiophene is typical art, wherein such porous materials carrying sulfur compound have been interested mainly to eliminate mercury from a gaseous material, not to eliminate from liquid hydrocarbons.

However, such art does not inhibit dissolution of the sulfur contained in the adsorbents into the liquid hydrocarbon as contamination, in addition to elimination of sulfur as subject purpose. Liquid hydrocarbon are mostly subjected to the hydrogenation at the stage of intermediate product, wherein contaminant or impurity sulfur contained in such hydrocarbon gives serious damage to the catalysts for hydrogenation. therefore, the dissolution of sulfur into such hydrocarbon should be prevented at all. Then, unfortunately, the disclosed active carbons carrying sulfur or sulfur compounds have been found to dissolve the carried sulfur or sulfur compound into the liquid hydrocarbons (dissolved concentration is about 10–400 ppm).

SUMMARY OF THE INVENTION

An object of the invention is to provide method of eliminating mercury and its compounds substantially completely from liquid hydrocarbons wherein contained mercury and its compounds at a slight amount, by means of contacting activated carbon or activated carbon carrying alkaline or alkaline earth metal sulfide with the liquid hydrocarbons.

Another object of the invention is to provide particular method of preparing the activated carbon noted, by means of activating a carbonaceous material in a circumstance comprising water vapor less than 15% on volume basis and providing thus treated active carbon with alkaline earth metal sulfide as carried substance. Said activated carbons are used for elimination of mercury and its compounds in liquid hydrocarbon in this invention.

A part of advantage is to bring about effects such that the inventive method will eliminate the mercury from the hydrocarbons to such extent that no substantial harm will occur the hydrocarbons of interest due to uneliminated mercury as well as dissolution of sulfur into the liquid hydrocarbons during subsequent processes which converts the hydrocarbons into petroleum products and petrochemical products.

Specifically it has been found that the preparation of activated carbons should be changed, that is, activation conditions should be changed to provide the product activated carbon with capability of substantially complete elimination of mercury and its compounds, in other words, water vapor should be present less than 15% on volume basis in the activation circumstance. And then, thus obtained activated carbon should be provided with alkaline or alkaline earth metal sulfide as carrier, wherein the finished activated carbon preferably meet such physical condition as micropore radii: 5–500 angstrom and specific surface: 200–2500 $m^2/g$.

Other objects and advantages will be apparent through description in this specification.

DESCRIPTION OF THE PREFERRED EMBODIMENTS

Reference will be made to activation gas, it normally contains water vapor and carbon dioxide gas. Then, the activation gas of the present invention is not limitative as to a content of carbon dioxide component, but water vapor should be less than 15%. In contrast to the present invention, normal activation gases contain water vapor in the range of 40–60%, much higher level. Background is that activation rate for carbonaceous materials caused by water vapor is remarkably higher than that by carbon dioxide, so that composition of the activation gas is normally designated to have have a higher content of water vapor than that of carbon dioxide. Therefore, limitation imposed on the present invention provides the subject gas with activation conditions which will effect much milder and slower activation rate as compared with normal gases for similar purpose. As shown hereinafter in Examples 1–4 and Comparative Examples 1–4, and Table 1, the activation under high water vapor contents results in lowering in adsorption of mercury.

Detailed mechanism to explain why the activation under low water vapor content gives higher mercury adsorption is not clear, though, it is presumed that such activation condition builds up such micropore structures as will adsorb mercury more suitably. In the activation process, it is preferable to maintain similar gas composition to the activation gas even in the step of cooling until activated carbon is cooled under 300° C. and then to remove such activated carbon, wherein said similar gas composition is referred to not mean that cooling gas should have the same composition as activation gas, but to mean that if circumstance composed of nitrogen gas, carbon dioxide gas or mixture thereof (content of oxygen, hydrogen are less than 1–2%) is used for activation, such gas circumstance is allowable for cooling which comes to be continued process from activation.

Raw material to the activated carbon is not limitative, but acceptable where such comes from coal, charcoal, coconut shell, timber, synthetic resin or the like.

As for specification of the activated carbon for use as carrier, micropore radii: 5–500 angstroms, preferably 10–100 angstroms, and specific surface: higher than 200 $m^2/g$, more preferably higher than 500 $m^2/g$, and in converse, preferably lower than 2500 $m^2/g$, more preferably lower than 1500 $m^2/g$. Further residue after strong heating: less than 10 weight % is preferable. Higher elimination of mercury will be attained with use of activated carbon having its specification in preferable range.

Form of activated carbon is not limitative, and any of powder, crushed particles, cylindrical form, globular form, fibrous form, or honeycomb is acceptable. Such a form as granular or cake is manufactured through the ordinary process including knealing of carbonaceous material (100 parts), mixed with oil pitch or coal tar (30–60 Parts ) as binder, and then such carbonaceous material is subjected to activation.

The present invention allows the activated carbons prepared specifically as noted to be used in the state of simple body or as it is, and further allows such activated carbons to be converted to carrier with carried substance, that is, activated carbon with alkaline metal sulfide and/or alkaline earth metal sulfide is preferable. These sulfur containing compounds will enhance the adsorption of mercury with scarce sulfur dissolution into liquid hydrocarbon.

Alkaline metal sulfide and alkaline earth metal sulfide as noted are not limitative, of which examples are: lithium sulfide, sodium sulfide, potassium sulfide (alkaline metal sulfide); magnesium sulfide, calcium sulfide (alkaline earth metal sulfide). Sole kind or joint use of two or more kinds is acceptable. As will be shown hereafter, Examples 5–8 and Table 2 indicate that, among metal sulfides, carrying sodium sulfide performs optimum results as to elimination of mercury.

Among range of carrying alkaline or alkaline earth metal sulfides is not limitative, but the range of 0.1–30 weight % on the weight basis of carrier is preferable. In the range less than 0.1%, resultant adsorption of mercury is not high enough, and more than 30%, adsorbability of the carrier is hindered by the carried compound and resultant adsorption of mercury is also not high enough.

When the metal sulfide carrying activated carbon of this invention, is used to eliminate mercury and its compound in liquid hydrocarbon as adsorbent, sulfur carried on the activated carbon scarcely dissolves into liquid hydrocarbon during the activated carbon contacts with liquid hydrocarbon.

As shown hereinafter in Examples 5–8 and Table 2, the amount of sulfur dissolved into liquid hydrocarbon is extremely low level (less than 1.0 mg/Kg). This is another advantage of this invention, because liquid hydrocarbons containing sulfur will harm catalysts seriously which are often applied during process for such intermediates of petroleum products and petrochemical products.

Activated carbon prepared by conventional process which carrying sulfur or its compound, has high adsorbability of mercury in liquid hydrocarbons, as mentioned in prior art description. However, large amount of sulfur and its compound is dissolved into liquid hydrocarbon, during the activated carbon contacts with liquid hydrocarbon, as shown hereinafter in Comparative Examples 5, 6 and Table 2. Therefore, these activated carbons are not allowed to be used for mercury adsorption of liquid hydrocarbons.

Reference will be made to the process of providing the carried substance or compound with the carrier activated carbon, a carried compound such as alkaline metal sulfide is solved into aqueous ammonia solution, or other inorganic or organic solvent such as acetone, alcohol and into this solution, the activated carbon is submerged for the compound to be adsorbed and then dried in oven at 110°–400° C., preferably 110°–200° C.

Alternative method for the submerging noted is, for example, to apply the compound solution, like shower or spray, onto the activated carbon, wherein stirring the activated carbon improves uniform reception.

As for circumstance while drying the applied activated carbon as noted, limitation is not present and then, air, nitrogen, or combustion gas from liquefied petroleum gas is usable.

Liquid hydrocarbons, objective of the inventive method, are meant to include such broad scope that the adsorption through contact between solid phase activated carbon and liquid phase hydrocarbon is feasible, and they are mainly found in intermediates leading to petroleum product and petrochemical product. For example, naphtha or other petroleum intermediate or in-process goods consisting of hydrocarbons with 6–15 carbon atoms and lying liquid at ambient temperature. Others are liquefied oil based or coal based hydrocarbons, for example.

As for hydrocarbons having not more than 5 carbon atoms and lying gas at ambient temperature, such hydrocarbons are applied to the inventive method after liquefaction by pressure. In particular, liquefied natural gas (LNG), liquefied petroleum gas (LPG), liquefied ethylene, liquefied propylene, and naphtha are handled in liquid state, and such material may be applied to the present invention with no preliminary treatment to liquefaction, so that the inventive method provides industrial utility with material hydrocarbons noted. These hydrocarbons may be single component or mixture of two or more components.

In the cases that the adsorption is performed with use of a fixed bed filled with activated carbon, particles size thereof may be 4.75–0.15 mm, preferably 1.70–0.50 mm.

Reference will be made to mercury in the present invention, the mercury even if lying mercury simple body, inorganic or organic mercury compound is applicable to the inventive method and elimination thereof is enough to reach a trace level or extremely low level.

In the case that mercury concentration is at 100 μg/kg, the inventive activated carbon 1 kg will eliminate about 0.1–10 g mercury, though necessary amount of the activated carbon depends upon target elimination amount.

Assuming that liquid hydrocarbon is in—process goods leading to the reforming process, normally such contains mercury at 0.002–10 mg/kg. Therein prior filtration of the liquid hydrocarbon is desirable to eliminate sludge therefrom wherein mercury component separable together with sludge is desirably removed.

EXAMPLES

Example 1

Carbonized coconut shell, mesh cut mass of 4–14 mesh (larger than 1.7 mm, smaller than 4.75 mm) was used as raw material of activated carbon. This material was activated under circumstance composed of liquefied petroleum gas combustion gas (gas composition: nitrogen 80%, oxygen 0.2%, carbon dioxide 9.8%, water vapor 10%) at 900° C., and resultant specific surface 1400 $m^2/g$ was reached and cooled in the same gas down to 300° C. Thus prepared activated carbon was crushed to mesh range 10–32 (large than 0.5 mm, smaller than 1.7 mm). This activated carbon has ash content (residue after strong heating) 2.5 weight %.

Light naphtha (hydrocarbon $C_6$ to $C_9$) containing mercury at different levels was used and adsorption on different levels were measured with use of the activated carbon noted, wherein 20% of mercury contained in the light naphtha was shared by organic mercury compound. The light naphtha 100 ml was put into contact with the activated carbon 10 g under mixing. Mercury concentration of the naphtha after the adsorption was measured after 2 hours in the 3 cases of mercury concentration at 100, 10, 1 μg/kg at the start, and thereby the performance was rated and shown in Table 1 wherein ○ indicates good, or acceptable and X indicates fail or unacceptable.

Example 4

Phenol resin fiber (NIPPON KYNOL CO., LTD. Brand-name KYNOL FIBER) was used to prepare to the activated carbon. Excepting the use of this fiber, activated carbon fiber was prepared in the same way as in Example 1. The mercury adsorption by this fiber is proved to be good as shown in Table 1.

Comparative Example 1 to 4

Activated carbon particle and activated carbon fiber made from phenol resin fiber were prepared in the same way as in Example 1 and 4 excepting change in the activation gas composition, and then mercury adsorption was measured, and results are shown in Table 1.

It is proved that the activation gas containing water vapor more than 15% reduces the adsorption of mercury as well as organic mercury largely and hence such activated carbon is not allowed to be used for mercury adsorption.

TABLE 1

| | Raw Material of Activated Carbon | Activation gas $H_2O:CO_2:N_2:O_2$ (Vol. %) | Specific Surface Area ($m^2/g$) | Pore Size (radius) (Å) | Adsorption of Mercury (mg/g) Mercury Concentration (μg/kg, Org. Mercury shares 20%) 100 | 10 | 1 | Adsorption of Organic Mercury | Dissolution of Sulfur | Evaluation of Total Adsorbability |
|---|---|---|---|---|---|---|---|---|---|---|
| Example 1 | Coconut Shell | 10:9.8:80:0.2 | 1400 | 12 | 0.147 | 0.0269 | 0.0035 | ○ | <0.1 | superior |
| Example 2 | Coconut Shell | 14:25:60.9:0.1 | 1400 | 12 | 0.125 | 0.0210 | 0.0020 | ○ | <0.1 | superior |
| Example 3 | Coconut Shell | 8:8:83.8:0.2 | 1400 | 12 | 0.135 | 0.0250 | 0.0025 | ○ | <0.1 | superior |
| Example 4 | Phenol Fiber | 10:9.8:80:0.2 | 1400 | 10 | 0.208 | 0.0302 | 0.0045 | ○ | <0.1 | superior |
| C. Example 1 | Coconut Shell | 17:22:60.8:0.2 | 1400 | 12 | 0.060 | 0.0110 | 0.0010 | X | <0.1 | inferior |
| C. Example 2 | Coconut Shell | 20:19:60.9:0.1 | 1400 | 12 | 0.040 | 0.0050 | 0.0005 | X | <0.1 | inferior |
| C. Example 3 | Coconut Shell | 30:9:60.8:0.2 | 1400 | 12 | 0.030 | 0.0040 | 0.0003 | X | <0.1 | inferior |
| C. Example 4 | Phenol Fiber | 20:19:60.9:0.1 | 1400 | 10 | 0.050 | 0.0065 | 0.0006 | X | <0.1 | inferior |

Note;
1. C. Example indicates Comparative Example.
2. Phenol Fiber indicates Phenol Resin Fiber.

As shown in Table 1, mercury adsorption by the activated carbon is good, and no organic mercury compound is found in the naphtha subsequent to the adsorption. In conclusion, the inventive activated carbon is proved to have superior performance.

Example 2 and 3

The activated carbon particles was prepared in the same way as in Example 1 excepting different gas composition used, and mercury adsorption was measured in the same way as in Example 1. Results are shown in table 1. The performance is rated good at each case. Thus it is proved that the activation gas containing water vapor less than 15%, leads the performance to be good.

Example 5

The activated carbon obtained in Example 1 was used. Sodium sulfide solution ($Na_2S{\cdot}9H_2O$, reagent first class, KATAYAMA KAGAKU KOGYO) wherein 7.5 g was dissolved in water 100 ml. was sprayed onto the activated carbon under mixing. Thus treated was at 130° C. for dried 3 hours to yield the activated carbon carrying $Na_2S$ 1 weight % as sulfur. Adsorption of mercury was measured in the same way as Example 1 and results are shown in Table 2. The activated carbon carrying sodium sulfide shows good performance and no dissolution of sulfur is found, and thus field service for mercury elimination is feasible.

TABLE 2

| | Specific Surface Area ($m^2/g$) | Carried Substance | Sulfide, Sulfur (wt. %) (terms, sulfur) | Adsorption of Mercury (mg/g) Mercury Concentration (μg/kg, Org. Mercury shares 20%) 100 | 10 | 1 | Adsorption of Organic Mercury | Dissolution of Sulfur | Evaluation of Total Adsorbability |
|---|---|---|---|---|---|---|---|---|---|
| Example 5 | 1400 | Sodium sulfide | 1.0 | 0.230 | 0.0354 | 0.0083 | ○ | <0.1 | superior |
| Example 6 | 1400 | Sodium sulfide | 2.0 | 0.280 | 0.0453 | 0.0125 | ○ | <0.1 | superior |
| Example 7 | 1400 | Potassium sulfide | 1.0 | 0.210 | 0.0400 | 0.0065 | ○ | <0.1 | superior |
| Example 8 | 1400 | Magnesium sulfide | 1.0 | 0.158 | 0.0305 | 0.0051 | ○ | <0.1 | superior |
| C. Example 5 | 1400 | Sulfur | 1.0 | 0.315 | 0.0650 | 0.0185 | ○ | 380 | inferior |
| C. Example 6 | 1400 | Organic Sulfur | 1.0 | 0.305 | 0.0550 | 0.0175 | ○ | 350 | inferior |

Example 6

The activated carbon was prepared in the same way excepting that carried sodium sulfide was 2 weight %. This shows in Table 2 good mercury adsorption and no dissolution of sulfur is found.

Example 7 and 8

Activated carbon carrying sulfur containing compound were prepared with potassium sulfide and magnesium sulfide wherein the activated carbon with potassium sulfide was prepared in Example 7 and the one with magnesium sulfide was prepared in Example 8. These activated carbon show good mercury adsorption shown in Table 2 and no dissolution of sulfur is found.

Comparative Example 5

The activated carbon obtained in Example 1 was used to prepare the activated carbon carrying sulfur, wherein activated carbon particle 100 g was mixed uniformly with powder sulfur 1 g and heated to yield carrying 1 weight %. Adsorption was measured as in Example 1 and results were shown in Table 2.

As is indicated in Table 2, the activated carbon carrying sulfur has good mercury adsorption, but dissolution of sulfur is much and therefore unacceptable for mercury adsorption to treat liquid hydrocarbons including naphtha or other intermediates of oil products.

Comparative Example 6

The activated carbon obtained in Example 1 was used to prepare the activated carbon carrying thiourea, wherein thiourea solution was sprayed uniformly onto activated carbon particle and heated and dried 130° C., 3 hours to yield carrying organic sulfur compound 1 weight %. Adsorption was measured as in Example 1 and were shown in Table 2.

As shown in Table 2, the activated carbon carrying thiourea shows good mercury adsorption, but dissolution of sulfur is much and therefore unacceptable for mercury adsorption to treat liquid hydrocarbons including naphtha or other intermediates of oil products.

Example 9

The activated carbon obtained in Example 1 was packed uniformly in a column (diameter: 30 cm, height: 1m), whereinto light naphtha containing mercury concentration 6 μg/kg at LV (linear velocity), 0.30 m/min. was passed. thus treated naphtha contained mercury less than 0.1 μg/kg, substantially complete elimination was proved. Also organic mercury compounds was completely eliminated and dissolution of sulfur into naphtha was less than 0.1 mg/kg, scarce dissolution was proved.

The mercury elimination from liquid hydrocarbons of the present invention has proved superior performance by combining the specially prepared activated carbon or that with carrying of alkaline metal sulfide so that a slight amount of mercury contained in liquid naphtha is substantially completely eliminated and that no side effect of dissolution of carried sulfur component into the liquid hydrocarbon is found. Liquid hydrocarbons containing mercury or sulfur will harm catalysts which are often applied during process for such intermediates of petroleum products and petrochemical products. Thus the present method is advantageous to processing of such oil intermediates.

What is claimed is:

1. A method of eliminating mercury or compounds thereof contained in a liquid hydrocarbon comprising contacting said liquid hydrocarbon with activated carbon, wherein the activated carbon is prepared by activating a carbonaceous material with activating gas comprising less than 15% by volume of water vapor.

2. The method of claim 1, wherein the activated carbon has a specific surface area of 200–2500 $m^2/g$.

3. The method of claim 2, wherein the specific surface area is in the range of 500–1500 $m^2/g$.

4. The method of claim 1, wherein the activated carbon has micropore radii in the range of 5–500 Å.

5. The method of claim 4, wherein the activated carbon has a specific surface area of 200–2500 $m^2/g$.

6. The method of claim 4, wherein the micropore radii are in a range of 10–100 Å.

7. The method of claim 6, wherein the specific surface area is in the range of 500–1500 $m^2/g$.

8. The method of claim 1, wherein the volume percent of water vapor is 10% or less.

9. The method of claim 1, wherein the volume percent of water vapor is 8% or less.

10. A method of eliminating mercury or compounds thereof contained in a liquid hydrocarbon comprising contacting said liquid hydrocarbon with activated carbon carrying an alkali metal sulfide or an alkaline earth metal sulfide or mixtures thereof, wherein the activated carbon is prepared by activating a carbonaceous material with activating gas comprising less than 15% by volume of water vapor.

11. The method of claim 10, wherein the amount of alkali metal sulfide or alkaline earth metal sulfide is 0.1–30 wt. % based on the weight of activated carbon.

* * * * *